US005511333A

United States Patent [19]

Farrell

[11] Patent Number: 5,511,333

[45] Date of Patent: Apr. 30, 1996

[54] PAINTBALL CLIP MAGAZINE

[76] Inventor: Kenneth R. Farrell, 19202 SE. 184 St., Renton, Wash. 98058

[21] Appl. No.: 393,544

[22] Filed: Feb. 23, 1995

[51] Int. Cl.[6] ..... F41B 11/02

[52] U.S. Cl. ..... 42/49.01; 221/310

[58] Field of Search ..... 42/49.01; 89/34, 89/33.1; 221/309, 310, 250, 64, 65; 294/19.2; 224/919

[56] References Cited

U.S. PATENT DOCUMENTS

| | | | |
|---|---|---|---|
| 1,157,571 | 10/1915 | Moench | 42/49.01 |
| 1,810,491 | 6/1931 | McClure | 221/309 |
| 2,294,001 | 8/1942 | Ritter | 221/310 |
| 3,165,849 | 1/1965 | Into | 42/49.01 |
| 3,412,897 | 11/1968 | Slater | 221/226 |
| 3,435,988 | 4/1969 | Jonas et al. | 221/310 |
| 3,637,109 | 1/1972 | Stifter | 221/310 |
| 4,299,345 | 11/1981 | Lanzl | 221/310 |
| 5,398,590 | 3/1995 | Snyder, Sr. | 89/34 |

FOREIGN PATENT DOCUMENTS

| | | | |
|---|---|---|---|
| 965058 | 3/1975 | Canada | 221/310 |

*Primary Examiner*—Stephen M. Johnson
*Attorney, Agent, or Firm*—Michael J. Folise

[57] ABSTRACT

A removable projectile magazine for paintball guns has a cylindrical, spring loaded housing with an opening at one end for receiving and ejecting paintballs. The end also has a one-way valve consisting of a plurality of flexible fingers subtending a hemispherical shape. The fingers permit insertion of paintballs into the housing but prohibit removal of the paintballs therefrom when the housing is not received on a gun. When received on paintball gun, a de-activating member forces the resilient fingers apart allowing the paintballs to exit from the housing.

15 Claims, 2 Drawing Sheets

PAINTBALL CLIP MAGAZINE

TECHNICAL FIELD

The invention relates to projectile magazines for containing a plurality of projectiles which are propelled and ejected by a gun. More specifically, the invention relates to paintball clip magazines for pneumatic paintball guns.

BACKGROUND OF THE INVENTION

The pneumatic paintball gun has achieved widespread acceptance both as a recreational sport item, and as a means for training police and military personnel in the use of conventional and semi-automatic weapons in combat-like situations. Products for the recreational paintball gun user, and products for police, military and para-military training have diverged and have become application specific. Recreational paintball users prefer paintball guns and accessories which permit rapid fire over large distances with large ammunition reserves. In contrast, the police, para-military, and military units such as special weapons and tactics prefer paintball guns and accessories which simulate close range performance of standard issue semi-automatic hand guns.

There are numerous differences between a pneumatic paintball gun, and a standard issue 45 caliber or 9 mm semi-automatic weapon. A paintball is a spheroid having a nominal diameter of approximately 0.69 inch, with a frangible shell manufactured from an acrylic material which is subsequently filled with a marking material in liquid form commonly referred to as "paint". This "paint" is actually a sophisticated polymer containing a water soluble dye. Paintballs are accelerated to relatively low velocities (maximum muzzle velocity of approximately 280 feet per second) with low accuracy especially at longer ranges. Conventional semi-automatic hand guns fire elongated bullets having a much smaller diameters and at much greater muzzle velocities (on the order of 1,000 feet per second or more) with greater accuracy at long distance.

While bullets are propelled by a small explosive charge within a bullet jacket, paintball guns typically use external sources of compressed gas such as carbon dioxide. Sophisticated valving arrangements release precisely measured amounts of compressed gas into a barrel of the paintball gun to propel the paintball when a trigger is depressed. Many paintball guns include mechanisms for semi-automatic operation which do not require manually recocking the gun after each shot. In addition, semi-automatic paintball guns automatically load another paintball into the firing chamber.

Paintball guns tend to be somewhat bulkier than their bullet firing hand gun analogs. Although hand-held paintball guns are known, such guns often employ an elongated paintball magazine which project perpendicularly from the axis of the gun barrel. This multiple projectile magazine is well suited for use in rifle-style paintball guns which are popular with recreational users. In addition, the industry has developed bulbous "hopper" type chambers to take the place of the previous enlongated style magazines. Both types of magazines employ the use of gravity to urge the paintball into the breach area of the paintball gun. Clearly, such designs do not simulate or emulate the smooth anal streamlined appearance of the typical semi-automatic pistol-type firearm. In contrast, modern 45 caliber and 9 mm firearms employ clip magazines which fit into the handgrip of the pistol or otherwise fit smoothly into the general envelope of the weapon. They do not interfere with withdrawal of the weapon from a holster. A trained user can remove the magazine from a semi-automatic pistol and install a new one in total darkness. In addition, firearm magazines do not rely on gravity feed and can feed bullets into the firing chamber of the gun regardless of gun orientation.

Thus, a need exists for a paintball magazine which contains a plurality of paintballs relatively equal to the number of bullets contained in a conventional pistol magazine, which fits smoothly into the general envelope of the paintball pistol, which can be removed and installed in total darkness, and which can feed paintballs into the breach portion of a paintball pistol regardless of the orientation of the pistol.

SUMMARY OF THE INVENTION

It is therefor an object of the present invention to provide a magazine for paintball guns, and for other projectile guns which fits generally into the envelope of the gun.

It is another objective of the present invention to provide a projectile magazine which can be installed and removed from a paintball gun in total darkness while achieving the above object.

It is a further objective of the invention to achieve the above objects in a magazine which permits passage of paintballs from the magazine to the breach of a gun, but which also prevents egress of paintballs from the magazine when the magazine is removed from the gun.

The invention achieves these objects and other objects and advantages of the invention which will be apparent from the description which follow by providing a housing for containing a plurality of projectiles, having an opening at one end for release of projectiles, a one-way valve mechanism allowing insertion of the projectiles into the housing and for preventing release of the projectiles when the housing is not mounted on the gun, and a de-activating mechanism adapted for mounting on the gun which de-activates the one-way valve mechanism when the housing is mounted on the gun.

In the preferred embodiment in the invention, the housing is in the form of a substantially hollow cylindrical magazine adapted to receive a plurality of paintballs in series. The housing is sealed at one end and open at the other end. The one-way valve is provided at the open end of the housing and is in the form of a hemispherical section consisting of a plurality of arcuate flexible fingers which define the surface of the hemisphere. A small opening is provided near the polar region of the hemisphere. The fingers are resilient, thus providing relatively little resistance to passage therethrough of paintballs from the concave side of the hemisphere, while providing much greater resistance to the passage therethrough from the convex side. The one-way valve is positioned in the open end with the convex side toward the interior of the housing. The de-activating mechanism takes the form of a ring or annulus which is connected to the paintball gun near a breach of a barrel on the paintball gun. The ring has an inner diameter which is slightly larger than the nominal diameter of a paintball, and a slightly smaller outer diameter than the inner diameter of the hemispherical one-way valve. When the housing or magazine is mounted on the gun, the ring or annulus engages and spreads the fingers apart in a radial direction. Paintballs are then free to pass through the one-way valve into the breach area of the gun. A spring or other bias mechanism can be included to urge paintballs to pass through the one-way valve when it has been de-activated by the de-activating mechanism.

DETAILED DESCRIPTION OF THE PREFERRED EMBODIMENTS

Figure 1:
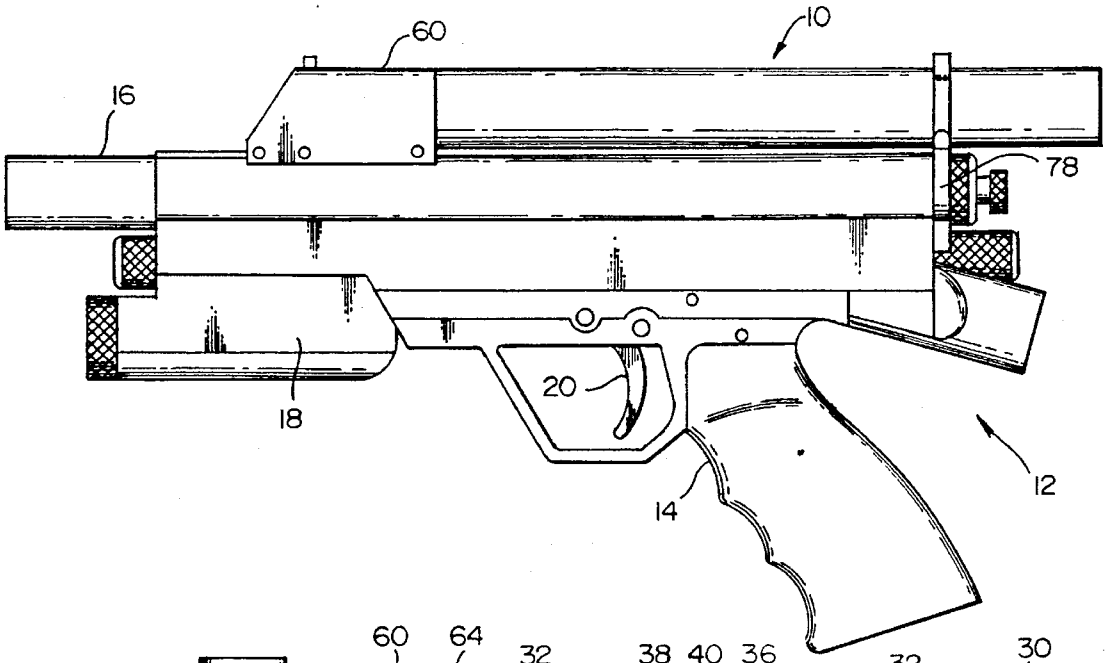
FIG. 1 is a side elevational view of a paintball gun employing the clip magazine of the present invention.

A projectile magazine, incorporating the concept of the invention is generally indicated at reference numeral 10 in the figures. In its preferred embodiment, the magazine is adapted for use with a conventional paintball pistol or gun 12 which is adapted to conform to the general shape and size characteristics of a 45 caliber or 9 mm semi-automatic pistol. The paintball gun 12 is substantially similar in its operational and structural characteristics to the pneumatic gun described in my issued U.S. Pat. No. 5,063,905 the disclosure of which is incorporated herein by reference. That pneumatic gun is adapted to fire paintballs and has been sold by Fastech, Inc., Renton, Wash. U.S.A. under the mark ILLUSTRATOR™. Paintball pistols of this type conventionally include a handle 14 for holding and drawing the gun from a holster (not shown), a barrel 16 for guiding a paintball projectile, a compressed gas source 18 for propelling the projectiles and a trigger 20 to selectively communicate the compressed gas source 18 with the barrel 16.

Figure 2:
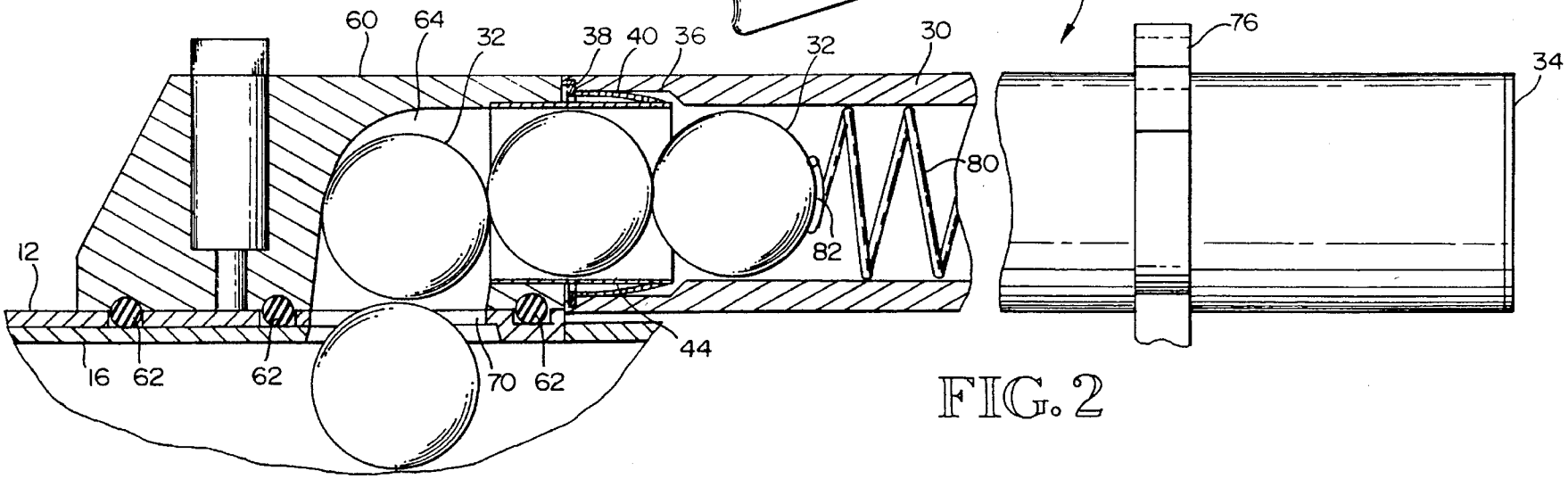
FIG. 2 is an enlarged, partial side elevational view of the clip magazine of FIG. 1 and a breach area of the paintball gun.

The magazine 10 shown in FIG. 2 incorporates a tubular or hollow cylindrical housing 30 having an inner diameter slightly larger than the nominal 0.69 inch diameter of a typical paintball 32. The housing is approximately 9 inches long and is sealed on one end by a cap 34. The remaining end of the housing has an enlarged inner diameter section 36 and a recessed, internal peripheral groove 38. The groove receives a unitary direction mechanism 40. The mechanism allows paintballs to be loaded into the magazine, permits egress of the paintballs from the housing whenever the housing is mounted on the gun 12, but prevents egress of the paintballs whenever the magazine is dismounted from the gun as shown in FIG. 3.

Figure 3:
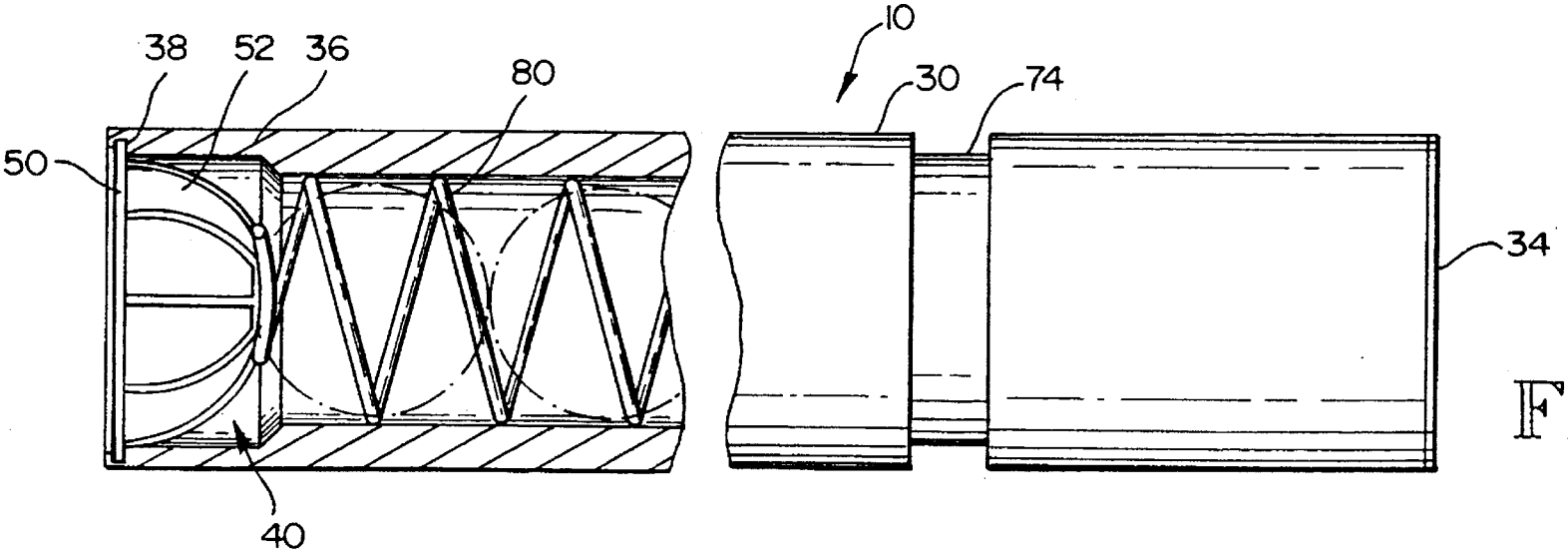
FIG. 3 is an enlarged, partial sectional view of the clip magazine removed from the gun with the one-way valve in its closed state.
Figure 4:
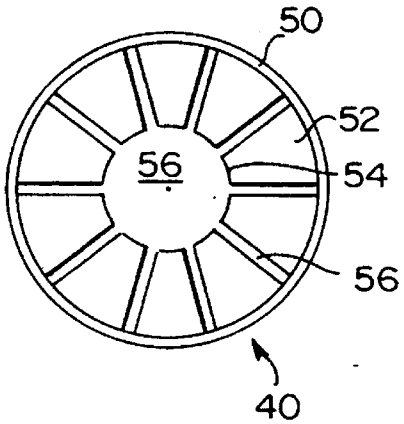
FIG. 4 is a front elevational view of the one-way valve shown in FIGS. 2 and 3.

The unitary direction mechanism 40 has an inactive position shown in FIG. 2, and an active position shown in FIGS. 3 and 4. As best seen in FIG. 3, when the housing 30 is not mounted on the gun 12, the unitary direction mechanism assumes a closed position which substantially prevents egress of paintballs from the housing, but which substantially permits introduction of paintballs into the housing as will be described further hereinbelow. However, when the housing is mounted on the gun as shown in FIG. 2, an annular ring 44 de-activates the unitary direction mechanism allowing paintballs to pass therethrough as shown.

As best seen in FIGS. 3 and 4, the unitary direction mechanism 40 has a circular, peripheral rim 50 with an outermost diameter of 0.940 inch so as to friction fit into the peripheral groove 38 of the housing 30. Ten arcuate, flexible, fingers emanate from the rim 50 so as to subtend a portion of a surface of an imagining hemisphere. This hemisphere has a radius of curvature of 0.490 inch. The fingers 52 however do not completely subtend the surface of this hemisphere and have curved edges 54 defining a spherical section or hole 56 having a base width of approximately 0.375 inch. In addition, the fingers are separated by a gap 56 of approximately 0.30 inch. The unitary direction mechanism 40 is preferably molded from a resilient thermoplastic material such as nylon or polyethylene.

The geometric shape and resilient structure of the unitary direction mechanism 40 as described above results in a one-way valve which is substantially less resistent to the passage therethrough of a spherical object, such as a paintball from the concave side, in comparison to the convex side. Thus, when the magazine 10 is dismounted from the pistol 12 as shown in FIG. 3, paintballs can be readily loaded into the magazine through the mechanism 40 while the paintballs remain captured inside the housing 30. However, whenever the housing is mounted on the pistol 12 as shown in FIG. 2, the ring 44 de-activates the unitary direction mechanism 40 by spreading the resilient fingers 52 apart allowing the paintballs 32 to pass through the inside of the ring. The ring 44 thus acts as a de-activating mechanism which cooperatively self engages the unitary direction mechanism 40 whenever the housing 10 is mounted on the gun 12. No other action, either by the gun or operator is required to de-activate the unitary direction mechanism 40.

The ring 44 is preferably made from a relatively hard material such as steel and is embedded in a mounting device 60 shown in FIGS. 1 and 2. The ring preferably has an outer diameter slightly smaller than the inner diameter of the peripheral rings, and an outer diameter slightly larger than the nominal diameter of a paintball.

The mounting device 60 is attached to the pistol 12 such as by transverse screws 62. The mounting device 60 defines a curved cylindrical passageway 64 having a nominal diameter of approximately 0.710 inch. The passageway allows passage of the paintball through the device and also through a breach area 70 of the pistol 12 and into the barrel 16 for subsequent projection therefrom by compressed gas. The passageway 64 should have sufficient clearance or play to allow the paintballs 32 to freely drop into the breach 70 without jamming in the passageway. That is, the passageway must be large enough to permit a paintball having a nominal diameter of 0.69 inch to roll freely therein so that the paintball does not jam. One method for making the passageway with appropriate dimensions is to plunge a 0.710 inch ball mill 0.930 inch deep along the horizontal direction of FIG. 2. Another plunge is then made from the bottom vertical direction of FIG. 2 to meet the first plunge. The result will be spherical ridge which starts the paintball in a downward direction to prevent jamming. Those of ordinary skill in the art will readily conceive of other concepts for forming the cavity in such a manner as to prevent jamming.

Due to the resilient nature of the fingers 52, the unitary direction mechanism 40 will reassume the "closed" position shown in FIG. 3 whenever the housing 30 is dismounted or removed from the pistol 12 so that the ring 44 no longer engages the fingers. In order to prevent inadvertent dismounting of the magazine 10 from engagement with the pistol 12 a rearward portion of the magazine is provided with an annular recess or groove 74. This groove 74 is sized to frictionally engage a resilient clip 76 made from a suitably flexible material such as plastic and defining a crescent or three quarter circle shape. The clip 76 has a lower portion 78 shown in FIG. 1 which is attached to the pistol 12. In this way, the magazine 10 can be quickly removed from or installed onto the pistol so as to simulate the use of a clip magazine in a conventional semi-automatic firearm.

To further facilitate egress of paintballs from the housing 30 whenever the magazine 10 is mounted on the pistol 12, the housing 30 is provided with an inner, coil compression spring 80 having one end (not shown) in contact with the end cap 34 and another end 82 terminated by bending across a diameter of the spring. The end 82 of the spring thus tends to rest against the curved fingers as shown in FIG. 3 when the magazine is empty.

Those of ordinary skill in the art will contemplate other embodiments and variations of the invention which although not shown in the figures, are considered part of this invention. For example, the size and dimension of the magazine 10 and its attendant components can be modified for shapes other than paintballs. For example, the magazine can be scaled downwardly in size to accept BB and/or pellets. In addition, the magazine can be adapted for receipt of projectiles having other than spherical shapes or for individual clips of projectiles which can be inserted into the magazine for "speed loading" in a fashion similar to that employed by some conventional firearms. Therefore, the invention is not be limited by the above description, but is to be determined in scope by the claims which follow.

I claim:

1. A removable magazine for a projectile gun, comprising:

a removable housing for containing a plurality of projectiles in series and defining an opening at one end for releasing the projectiles;

mounting means connected to the gun for removably mounting the housing to the gun;

a unitary direction mechanism at the one end of the housing allowing insertion of the projectiles into the housing and for selectively preventing release of the projectiles, wherein the unitary direction mechanism has a peripheral edge and a plurality of resilient, flexible fingers directed inwardly from the edge, the fingers being biased to a substantially closed position; and, a deactivating mechanism attached to the mounting means and adapted for cooperative engagement with the unitary direction mechanism so as to deactivate the unitary direction mechanism allowing release of the projectiles whenever the housing is mounted on the gun.

2. The magazine of claim 1, wherein the deactivating mechanism includes a projection sized and positioned to spread the fingers apart in an outward direction when the housing is mounted on the gun and the deactivating mechanism is engaged with the unitary direction mechanism.

3. The magazine of claim 2, adapted to receive spherical projectiles, wherein the housing is an elongated cylinder and the unitary direction mechanism has a substantially hemispherical shape and wherein the fingers substantially subtend a surface of the hemisphere and are directed towards an imaginary point on the surface of the hemisphere.

4. The magazine of claim 3, wherein the projection is an annular ring having a diameter larger than the diameter of the spherical projectiles.

5. The magazine of claim 1, adapted to receive spherical projectiles, wherein the unitary direction mechanism has a substantially hemispherical shape and wherein the fingers substantially subtend a surface of the hemisphere and are directed towards an imaginary point on the surface of the hemisphere.

6. The magazine of claim 1, wherein the housing includes a bias mechanism for biasing the projectiles towards the unitary direction mechanism and wherein the housing has a substantially constant inner diameter and wherein the bias mechanism is a coil spring having an outer diameter selected to closely conform to the inner diameter of the housing.

7. The magazine of claim 1, wherein the housing includes a bias mechanism for biasing the projectiles towards the unitary direction mechanism and including a clip adapted for permanent attachment to the gun, and wherein the housing is substantially cylindrical and has an outer, peripheral grove thereon for receipt of a circular portion of the clip.

8. The magazine of claim 1, wherein the housing is substantially cylindrical and has an outer, peripheral grove thereon for receipt of a adapted for attachment to the gun.

9. A removable magazine for a projectile gun comprising:

a removable housing for containing a plurality of projectiles and defining an opening at one end for releasing the projectiles;

a unitary direction mechanism at the opening allowing insertion of the projectiles into the housing and for selectively preventing release of the projectiles, wherein the unitary direction mechanism has a plurality of resilient, inwardly directed flexible fingers, the fingers being biased to a substantially closed position; and, a deactivating mechanism separate from the housing and adapted for mounting on the gun and further adapted for cooperative self engagement with the unitary direction mechanism whenever the housing is mounted on the gun so as to deactivate the unitary direction mechanism allowing release of the projectiles.

10. The magazine of claim 9 wherein the deactivating mechanism includes a projection sized and positioned to automatically spread the fingers apart in an outward direction whenever the housing is mounted on the gun and the deactivating mechanism is engaged with the unitary direction mechanism.

11. The magazine of claim 10 adapted to receive spherical projectiles, wherein the unitary direction mechanism has a substantially hemispherical shape and wherein the fingers substantially subtend a surface of a hemisphere and are directed towards an imaginary point on a surface of the hemisphere.

12. The magazine of claim 11, wherein the projection is an annular ring having a diameter larger than a diameter of the spherical projectiles.

13. The magazine of claim 9, wherein the housing includes a bias mechanism for biasing the projectiles towards the unitary direction mechanism and wherein the housing is substantially cylindrical and has a substantially constant inner diameter and wherein the bias mechanism is a coil spring having an outer diameter selected to closely conform to the inner diameter of the housing.

14. The magazine of claim 9, wherein the housing includes a bias mechanism for biasing the projectiles towards the unitary direction mechanism and wherein the housing is substantially cylindrical and has an outer, peripheral grove thereon for receipt of a clip adapted for attachment to the gun.

15. A selectively operable one way valve for a projectile gun magazine adapted to contain a plurality of spherical projectiles, comprising: a hemispherically shaped body defining concave and a convex sides and having a continuous edge defining a diameter of the body, the body also having a plurality of resilient flexible, arcuate fingers attached to the edge and substantially subtending a surface of the body in a direction towards an imaginary point on the surface, including a deactivating mechanism having a hollow annular projection having two open ends and a diameter larger than the spherical projectiles and smaller than the continuous edge so that the mechanism can be positioned to spread the fingers apart in an outward direction thereby allowing passage of the projectiles therethrough from the convex side whereby the fingers have a relatively low resistance to passage therethrough of the spherical projectiles from the conceive side and relatively high resistance to passage therethrough from the convex side and whereby the spherical projectiles and can pass through the annular projection.

* * * * *

UNITED STATES PATENT AND TRADEMARK OFFICE

CERTIFICATE OF CORRECTION

PATENT NO. : 5,511,333
DATED : April 30, 1996
INVENTOR(S) : Kenneth R. Farrell

It is certified that error appears in the above-indentified patent and that said Letters Patent is hereby corrected as shown below:

At column 6, line 10, insert a comma after the word "gun"
At column 6, line 27, insert a comma after the number "9"
At column 6, line 33, insert a comma after the number "10"
At column 8, line 2, delete the word "conceive" and insert the word --concave--

Signed and Sealed this

Twenty-seventh Day of August, 1996

*Attest:*

Bruce Lehman

BRUCE LEHMAN

*Attesting Officer*

*Commissioner of Patents and Trademarks*